US006360924B1

(12) United States Patent
Franzén

(10) Patent No.: US 6,360,924 B1
(45) Date of Patent: Mar. 26, 2002

(54) CONTAINER

(75) Inventor: Björn Franzén, Åsbro (SE)

(73) Assignee: Franzotech Invest AB, Asbro (SE)

( * ) Notice: Subject to any disclaimer, the term of this patent is extended or adjusted under 35 U.S.C. 154(b) by 0 days.

(21) Appl. No.: 09/806,929

(22) PCT Filed: Nov. 5, 1999

(86) PCT No.: PCT/SE99/02011

§ 371 Date: Apr. 6, 2001

§ 102(e) Date: Apr. 6, 2001

(87) PCT Pub. No.: WO00/27712

PCT Pub. Date: May 18, 2000

(30) Foreign Application Priority Data

Nov. 6, 1998 (SE) ..... 9803811

(51) Int. Cl.[7] ..... B65D 83/00
(52) U.S. Cl. ..... 222/468; 222/482; 222/484
(58) Field of Search ..... 222/468, 482, 222/484, 479

(56) References Cited

U.S. PATENT DOCUMENTS 3,251,514 A * 5/1966 Speicher ..... 222/468
4,412,633 A * 11/1983 Guerrazzi et al. ..... 222/468
5,340,000 A * 8/1994 Ring ..... 222/468
5,538,165 A 7/1996 Frohn
6,029,858 A * 2/2000 Srokose et al. ..... 222/468

FOREIGN PATENT DOCUMENTS

| | | |
|---|---|---|
| FR | 2 675 771 | 10/1992 |
| GB | 2 098 572 | 11/1982 |
| WO | WO 99/11524 | 3/1999 |

* cited by examiner

*Primary Examiner*—Philippe Derakshani
(74) *Attorney, Agent, or Firm*—Sughrue Mion, PLLC

(57) ABSTRACT

A container has a chamber (10) for liquid, a pouring opening (30) in the upper part of the chamber and having an essentially vertical longitudinal axis, and a handle (20) arranged above the chamber. In the handle there is an air duct (22), which at a first end emerges in the chamber and at a second end emerges in the pouring opening. In the pouring opening, a wall (34) is placed between a part (36) for liquid which is connected to the chamber and a part (38) for air in which the second end of the air duct emerges. An opening (40) is arranged in the wall between the part for liquid and the part for air. This opening ensures better manufacturing quality and ventilation when the container is emptied.

6 Claims, 2 Drawing Sheets

CONTAINER

TECHNICAL FIELD

The present invention relates generally to a container for liquids and relates more specifically to a container in which an air duct is arranged in a handle on the container.

BACKGROUND

A known problem with containers or cans for liquids is that a "gurgling" occurs when the liquid is poured out from the can, since the liquid comes out at an uneven rate. The reason for this is that when the liquid leaves the container, the pressure in the increasing air space inside the container falls. After a certain period, the difference between the pressure inside the container and the atmospheric pressure becomes such that air is suddenly drawn into the container and the flow is temporarily interrupted. The flow then continues and the pressure difference increases until the flow is again interrupted as air is sucked in. This therefore gives rise to the above-mentioned gurgling. The gurgling, apart from hindering the actual emptying procedure, also represents a risk, since the liquid which is poured out can splutter and splash. This is especially true, of course, in respect of hazardous substances, such as where the liquid in question is corrosive or otherwise harmful to health.

A known way of avoiding the above-mentioned problem is to arrange ventilation of the liquid space in the container. This can be achieved in a number of ways, one of which is to configure on the container a handle having a duct running therein, which duct at the one end connects to the liquid space and at the other end adjoins the pouring opening. A pressure equalization is thereby achieved, which essentially eliminates the said gurgling.

For such air ducts to work satisfactorily, they must connect to the pouring opening such that surrounding air is allowed to enter the air duct during the actual emptying procedure. This means that the air duct should extend close to the outlet part of the pouring opening. A problem with such air ducts is however that, for practical reasons, they are then given a configuration which comprises a curve. Examples of such solutions are encountered in patent specifications GB 2 098 572, EP 0 058 624, WO 98/35879 and BE 661164. The reason why a curve comes about is that on standard cans the pouring opening is sealed by means of a threaded cap and that the neck formed by the pouring opening must therefore be provided with external threads. This imposes limits on the ways in which the air duct can connect to the pouring opening. A typical configuration is shown in general representation in FIG. 1, which shows a section through a standard-shaped can.

One problem consists in the fact that liquid collects in the curve in the air duct, which liquid acts in this case as a water trap. The pressure-equalizing function of the air duct is thereby weakened or can even be eliminated.

A proposed solution to this problem is encountered in GB 2 098 572 and EP 0 058 624. In these it is proposed that a connecting duct or draining duct to the liquid space is arranged in the lowest part of the curve. This creates the problem, however, that liquid forces its way up in the duct during emptying, thereby preventing, ventilation. The desired function is consequently not obtained.

Another problem consists in the fact that the emptying procedure in known configurations is not wholly satisfactory. As the container is emptied, it is tilted, whereupon the liquid level rises in the pouring opening. The result is that an air duct which emerges in the pouring opening is blocked by the liquid which is present in the pouring opening during emptying. This leads in turn to the non-achievement of the desired ventilation function and to the continuation of the "gurgling" problem, i.e. the rate of emptying of the container remains uneven and hence not as good as might be expected.

The known technical solutions involving a duct which ends close to the neck opening further entail major problems in manufacture. Uneven quality is obtained with, for example, a recast air duct, or problems are obtained in connection with suitable wall thickness for the container. In order to reduce the risk of recasting of the duct, less material is used and over-thin walls are then obtained on the container in general. Conversely, if thicker material is used, the risk of recasting of the air duct is increased.

OBJECTS OF THE INVENTION

One object of the present invention is to achieve a container of the type stated in the introduction in which the problem of remaining liquid in the air duct has been solved in a better way than in the prior art and which consequently produces better emptying than in known containers of conventional construction.

Another object of the present invention is to achieve a container which can be made with good repeatability and quality in production.

SUMMARY OF THE INVENTION

The invention is based partly on the recognition that a more reliable construction is obtained if a slot or opening is arranged in the air duct at its connection with the pouring opening, whilst at the same time providing drainage of any remaining liquid in the air duct.

According to the invention, a container is thus achieved comprising a chamber, a pouring opening arranged in the upper part of the said chamber and having an essentially vertical longitudinal axis, a handle arranged above the chamber, an air duct arranged in the said handle, which air duct at a first end emerges in the chamber and at a second end emerges in the pouring opening, and a wall arranged in the pouring opening, which wall is placed between a part for liquid which is connected to the said chamber and a part for air in which the second end of the said air duct emerges, which container is characterized by an opening in the said wall arranged in the pouring opening between the part for liquid and the part for air.

Other preferred distinguishing features are defined by the appended sub-claims.

BRIEF DESCRIPTION OF THE DRAWINGS

The invention will be more closely described by way of example with reference to the appended drawing in which.

EMBODIMENTS

A preferred embodiment of a container according to the invention will be described below with reference to the figures. Where a relative direction is indicated in the description, such as "upper" or "above", reference is to those directions which are defined when the container is in upright position, i.e. the position shown in FIG. 1.

The container, denoted generally as 1, which is preferably made by blow molding, comprises a thin-walled, hollow body 10 forming a liquid chamber, a handle 20 and a pouring opening 30. The pouring opening 30 can be sealed by means of a screw-type sealing cap (not shown), so that the pouring opening is provided on the outside with screw threads 32. These screw threads impose a limit upon the shape of the pouring opening in that it must end in a circular neck.

Figure 1:
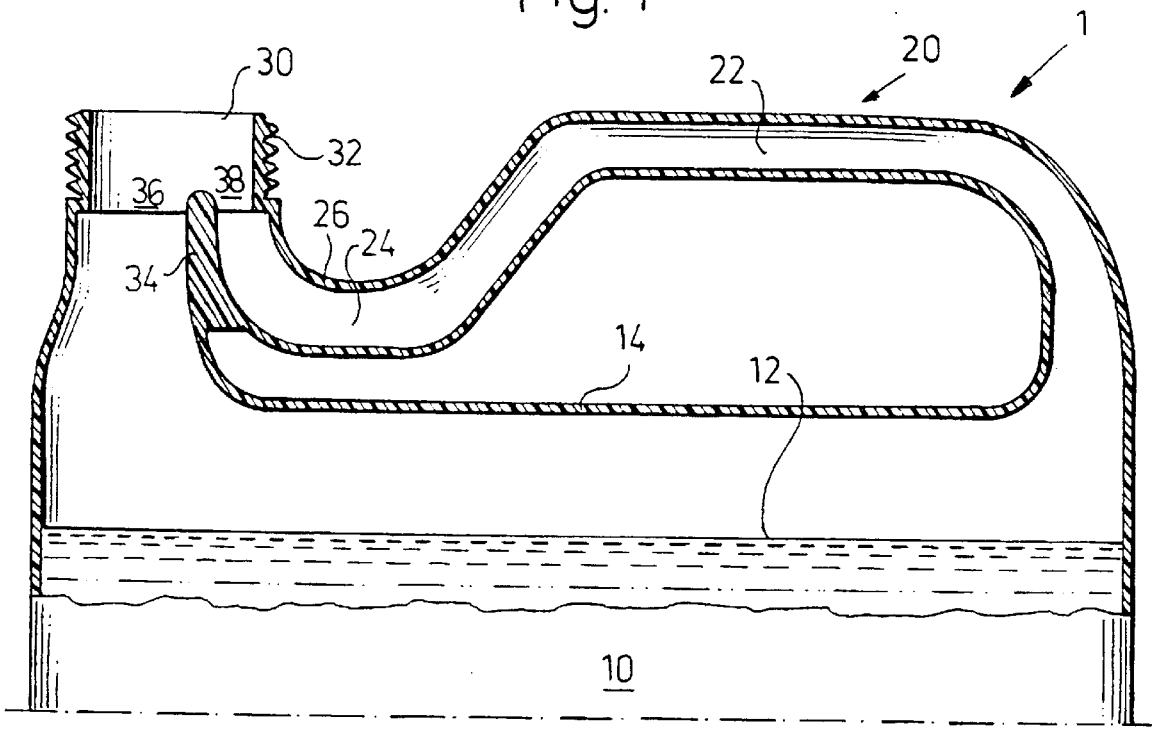
FIG. 1 shows a section through a container provided with an air duct in the handle.

The general function for an air duct 22 arranged in the handle 20 will be described below with reference to FIGS. 1 and 2. The container is initially in an essentially upright position, as can be seen from FIG. 1. Liquid in the body 10 of the container forms a surface 12, which in the figure is shown to lie below the upper limit wall 14 of the body 10. If the container is very full, the surface of the liquid can also lie above the level for this limit wall 14, i.e. the surface can lie in the pouring opening 30 and the duct 20.

Figure 2:
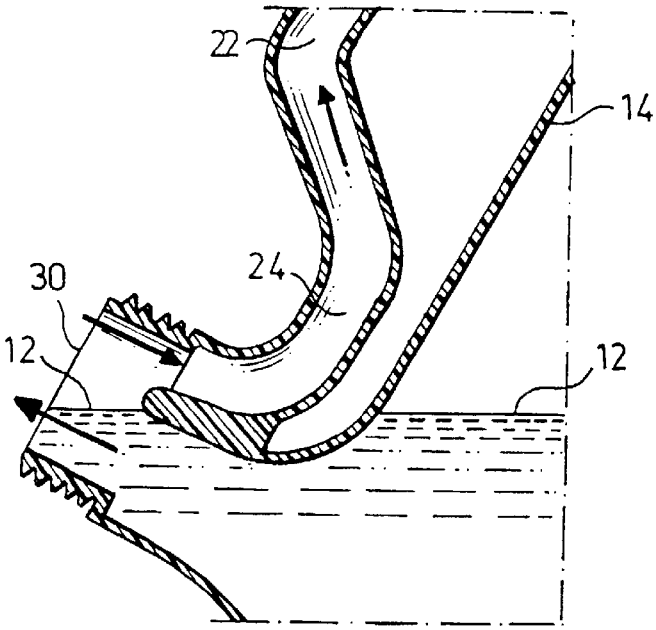
FIG. 2 shows the inflow and outflow through the pouring opening of air and liquid respectively in a container according to the invention, but with the container in tilted position during an emptying procedure.

In order to initiate the emptying procedure, the container 1 is tilted into a position exemplified in FIG. 2. The arrows in this figure indicate how air, via the duct 22, is made to enter into the interior of the body 10, i.e. the liquid chamber, during the emptying procedure. Pressure is thereby equalized between the surroundings and the liquid chamber and the above-mentioned gurgling problem is avoided.

Figure 3:
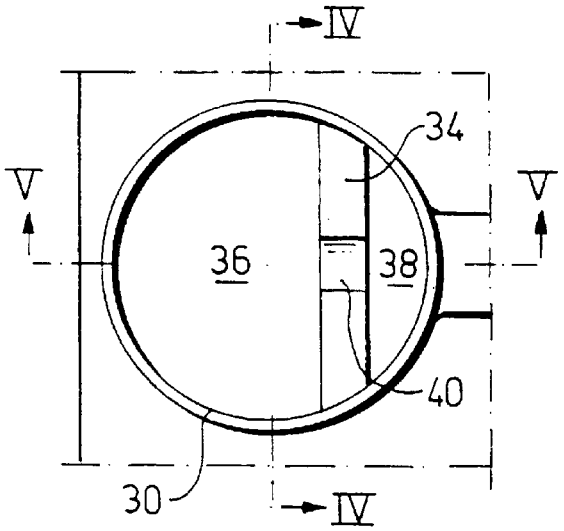
FIG. 3 shows a view from above of the pouring opening in a container according to the invention.

What can occur however, either following completed partial emptying or after transport, for example, is that liquid collects in that curve 24 in the air duct 22 which is formed in a can according to previously proposed solutions. To ensure that the liquid which runs to the curve 24 is led off back to the liquid chamber, the connection of the air duct 22 to the pouring opening is provided with a slot 40, which can more clearly be seen from FIGS. 3–5. This slot or notch is arranged in a wall 34, which separates off that part 36 of the pouring opening 30 through which outflowing liquid flows from that part 38 of the pouring opening through which air for pressure-equalization flows in, see FIGS. 1 and 2. If this wall 34 were not to exist, the outflowing liquid would totally or partially block the pouring opening 30 and thereby prevent or hinder the pressure equalization. For an optimal result, the wall ends somewhat below the upper end of the pouring opening. 30.

Figure 4:
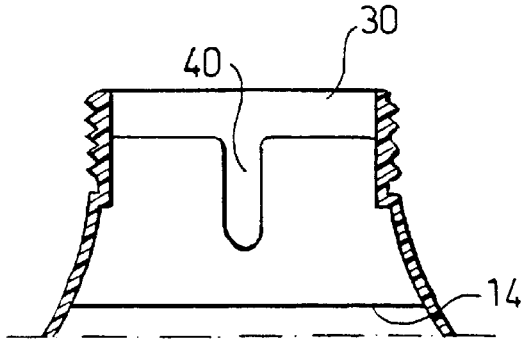
FIG. 4 shows a section along the lines IV—IV in FIG. 3.
Figure 5:
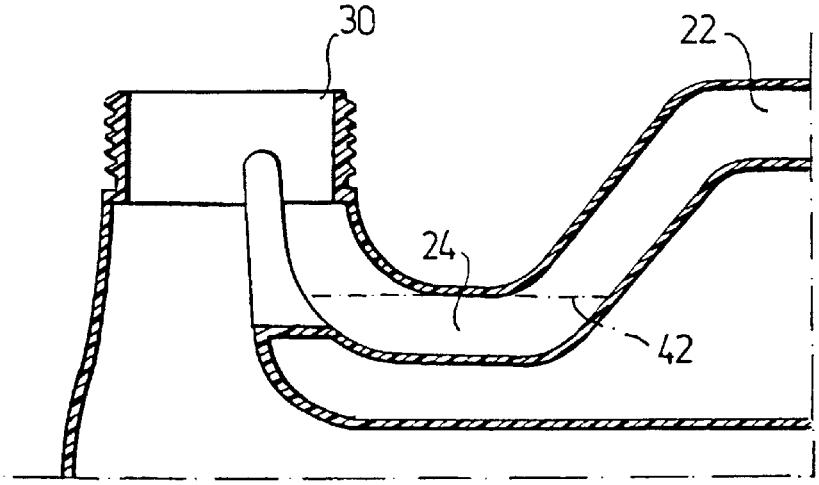
FIG. 5 shows a section along the lines V—V in FIG. 3.

The slot has a configuration which can be seen from FIGS. 4 and 5. In order to act as a drainage duct for the liquid which would otherwise collect in the curve 24, in the preferred embodiment the slot 40 extends down to a level equal to the centre of the air duct at the lowest part of the curve. This level is indicated by a dashed line 42 in FIG. 5.

Apart from acting as a drainage duct, the slot 40 has another important function, namely to increase the outflow rate in the emptying procedure. With the illustrated embodiment, the outflow rate is shown to be increased compared with if the slot were not present in the wall 34. The reason for this is that the air passes to the sides of the slot, whereby liquid can flow out from the pouring opening at the same time as air can flow into the air duct.

In addition, the shown embodiment offers repeatable and perfectly good casting. This has been difficult to achieve in previous containers of similar type, since the air duct in the region 38 has tended to be recast.

Although a container intended for sealing by means of a screw-type cap has been shown, the invention is also of course applicable to a container intended for a press-on cap.

It has further been shown that the slot 40, for drainage reasons, extends down to a level equal to the centre of the air duct at the lowest part of the curve. This function is also attained to a greater or lesser degree as long as the slot extends down to a level which lies below the upper part of the air duct at the lowest part of the curve. The slot 40 can even extend down to a level equal to the lower wall of the air duct in the region of the curve 24, thereby ensuring complete emptying of the latter when the can is returned to the original position shown in FIG. 1.

Although a slot or notch 40 has been shown which runs from the upper edge of the wall 34, an opening which goes all the way up to the upper edge of the wall 34 is also possible. This shape does not, however, offer as good emptying and manufacturing properties.

What is claimed is:

1. A container, comprising a chamber (10) for liquid, a pouring opening (30) arranged in the upper part of the said chamber (10) and having an essentially vertical longitudinal axis, a handle (20) arranged above the chamber, an air duct (22) arranged in the said handle, which air duct at a first end emerges in the chamber (10) and at a second end emerges in the pouring opening (30), and a wall (34) arranged in the pouring opening (30), which wall (34) is placed between a part (36) for liquid which is connected to the said chamber (10) and part (38) for air in which the second end of the said air duct (22) emerges, characterized by an opening (40) in the said wall (34) arranged in the pouring opening between the part (36) for liquid and the part (38) for air, wherein the opening (40) in the said wall is positioned in the pouring opening (30).

2. A container according to claim 1, characterized in that the opening (40) extends from the upper part of the said wall (34).

3. A container according to claim 1, characterized in that the opening (40) extends at least down to the level of an upper wall (26) of the air duct at the lowest point (24) of the air duct.

4. A container according to claim 1, characterized in that the opening (40) extends at least down to the level of the lower wall of the air duct at the lowest point (24) of the air duct.

5. A container according to claim 1, characterized in that the container is blow-moulded.

6. A container according to claim 1, characterized by a screw thread arranged on the outer side of the pouring opening (40).

* * * * *